US006968062B1

(12) United States Patent
Inanaga

(10) Patent No.: US 6,968,062 B1
(45) Date of Patent: Nov. 22, 2005

(54) TRANSMITTER OF INFRARED TRANSMISSION SYSTEM AND REPRODUCING APPARATUS COMPRISING HEADPHONE DEVICE

(75) Inventor: Kiyofumi Inanaga, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/508,073

(22) PCT Filed: Jul. 23, 1999

(86) PCT No.: PCT/JP99/03972

§ 371 (c)(1),
(2), (4) Date: Mar. 13, 2000

(87) PCT Pub. No.: WO00/05921

PCT Pub. Date: Feb. 3, 2000

(30) Foreign Application Priority Data

Jul. 23, 1998 (JP) ..... P10-207354

(51) Int. Cl.[7] ..... H04H 5/00
(52) U.S. Cl. ..... 381/2; 381/14; 398/140
(58) Field of Search ..... 381/2, 14, 16; 359/115, 180, 154, 172, 181; 370/521; 375/299, 375/295; 455/63, 66; 398/140

(56) References Cited

U.S. PATENT DOCUMENTS 5,406,634 A * 4/1995 Anderson et al. ..... 381/82
5,483,367 A * 1/1996 Han ..... 398/115
5,602,669 A * 2/1997 Chaki ..... 398/188
6,021,205 A * 2/2000 Yamada et al. ..... 381/310
6,553,121 B1 * 4/2003 Matsuo et al. ..... 381/17

OTHER PUBLICATIONS

Translation of JP05260024A Oct. 1993 Japan, Ono, Takashi.*

* cited by examiner

*Primary Examiner*—Brian T. Pendleton
(74) *Attorney, Agent, or Firm*—Jay H. Maioli

(57) ABSTRACT

This invention is directed to a transmitting apparatus adapted for carrying out transmission of audio signals by using infrared rays and a reproducing apparatus using a headphone device adapted to receive audio signals transmitted from the transmitting apparatus to reproduce them. The transmitting apparatus allows digital audio signal to undergo time axis compression every unit time period, and to repeat the same contents to transmit such repetitive signals by infrared rays. The headphone device comprises a light receiving element for receiving infrared rays, and a memory adapted so that valid signals of the received repetitive signals are written thereinto and the written signals are caused to undergo time axis expansion and are read out therefrom to allow the signals which have been read out from the memory to undergo D/A conversion to deliver the signals thus obtained to speaker units of the headphone device to reproduce them.

8 Claims, 12 Drawing Sheets

TRANSMITTER OF INFRARED TRANSMISSION SYSTEM AND REPRODUCING APPARATUS COMPRISING HEADPHONE DEVICE

TECHNICAL FIELD

This invention relates to a transmitting apparatus adapted for carrying out transmission of audio signals by using infrared rays, and a reproducing apparatus using a headphone device, which is adapted to receive audio signals transmitted from such transmitting apparatus to reproduce the audio signals thus received.

BACKGROUND ART

Audio signals in cinema are caused to be signals of multi-channel structure, and are recorded on the assumption that such multi-channel audio signals are reproduced by speaker units placed at both sides in left and right directions of the screen and speaker units placed at the backward side in left and right directions or both sides in the left and right directions of listener. By reproducing audio signals recorded in the state caused to be of multi-channel structure by a large number of speaker units disposed by a fixed arrangement as stated above, position of sound source within the screen and position of sound image actually heard are in correspondence with each other so that sound field having natural expansion or spreading is established.

When audio signals caused to be of multi-channel structure are also appreciated by using headphone device used in the state affixed on the head portion of listener, sound image is localized within the head of listener, resulting in extremely unnatural sound image localization. Moreover, also similarly in the case where music which does not involve image, etc. is appreciated by the headphone device, sound is heard from within the head unlike the case of speaker reproduction. Thus, in natural sound field is similarly formed, and there result an unnatural reproduction of sound.

Further, since headphone devices conventionally widely used are connected to audio equipment or image equipment through external connection cords, when such headphone device is affixed onto the head portion, connection cord is extended from the head portion. For this reason, it is difficult to obtain satisfactory fitting feeling.

In order to eliminate disagreement of feeling of fitting, etc. resulting from the fact that such connection cord is used, it is conceivable that a transmitting circuit using infrared rays is provided at audio equipment or image equipment adapted to output audio signals, and there is used a headphone device adapted to receive audio signals transmitted from this transmitting circuit by infrared rays to reproduce them.

Meanwhile, in the case where transmission system of audio signals using infrared rays is employed, when screening object of light such as human being passing between infrared ray transmitting unit of audio equipment, etc. and headphone device affixed to the listener is interposed, transmission of audio signals to the headphone device is interrupted, so reproduction sound is interrupted. In addition, when listener who has affixed headphone device walks about, it becomes impossible to precisely and continuously receive infrared rays transmitted from transmitting circuit provided at audio equipment, resulting in the possibility that reproduction sound may be interrupted.

DISCLOSURE OF THE INVENTION

In view of the above, this invention eliminates problems taking place by employment of conventionally proposed infrared transmission system to contemplate providing a transmitting apparatus capable of carrying out continuous transmission of audio signals and a reproducing apparatus using a headphone device which can carry out reproduction of audio signals without producing break or interruption of reproduction sound.

In order to attain such an object, a transmitting apparatus according to this invention comprises a memory into which digital audio signals are written and from which these written signals are repeatedly read out after undergone time axis compression every unit time period, a modulation circuit for carrying out modulation by signals which have been read out from this memory, and an infrared light emitting element for converting modulated signal outputted from the modulation circuit into infrared rays to output them.

In addition, a reproducing apparatus using a headphone device according to this invention comprises headphone device including a light receiving element adapted to receive infrared rays outputted from an infrared light emitting element of a transmitting unit to output modulated signal outputted from a modulation circuit, a demodulation circuit for demodulating the modulated signal outputted from the light receiving element to output repetitive signals, a memory into which valid signals of the repetitive signals outputted from this demodulation circuit are written and from which these written signals are read out after undergone time axis expansion, a D/A converter circuit for allowing the signal which has been read out from the memory to undergo D/A conversion to output an analog audio signal, and an electroacoustic conversion unit supplied with the analog audio signal outputted from the D/A converter circuit.

In the transmitting apparatus and the reproducing apparatus according to this invention, even if infrared rays outputted from the infrared light emitting element of the transmitting apparatus are temporarily interrupted, such an approach is employed to repeatedly transmit and receive audio signals, thereby making it possible to receive, by the reproducing apparatus, audio signals transmitted from the transmitting apparatus in the state where transmission of those signals is not interrupted to securely output continuous reproduction sounds.

Still further objects of this invention and more practical merits obtained by this invention will become more apparent from the description of embodiments which will be given below.

BEST MODE FOR CARRYING OUT THE INVENTION

A transmitting apparatus and a reproducing apparatus according to this invention will be described below in more practical manner with reference to the attached drawings.

Figure 1:
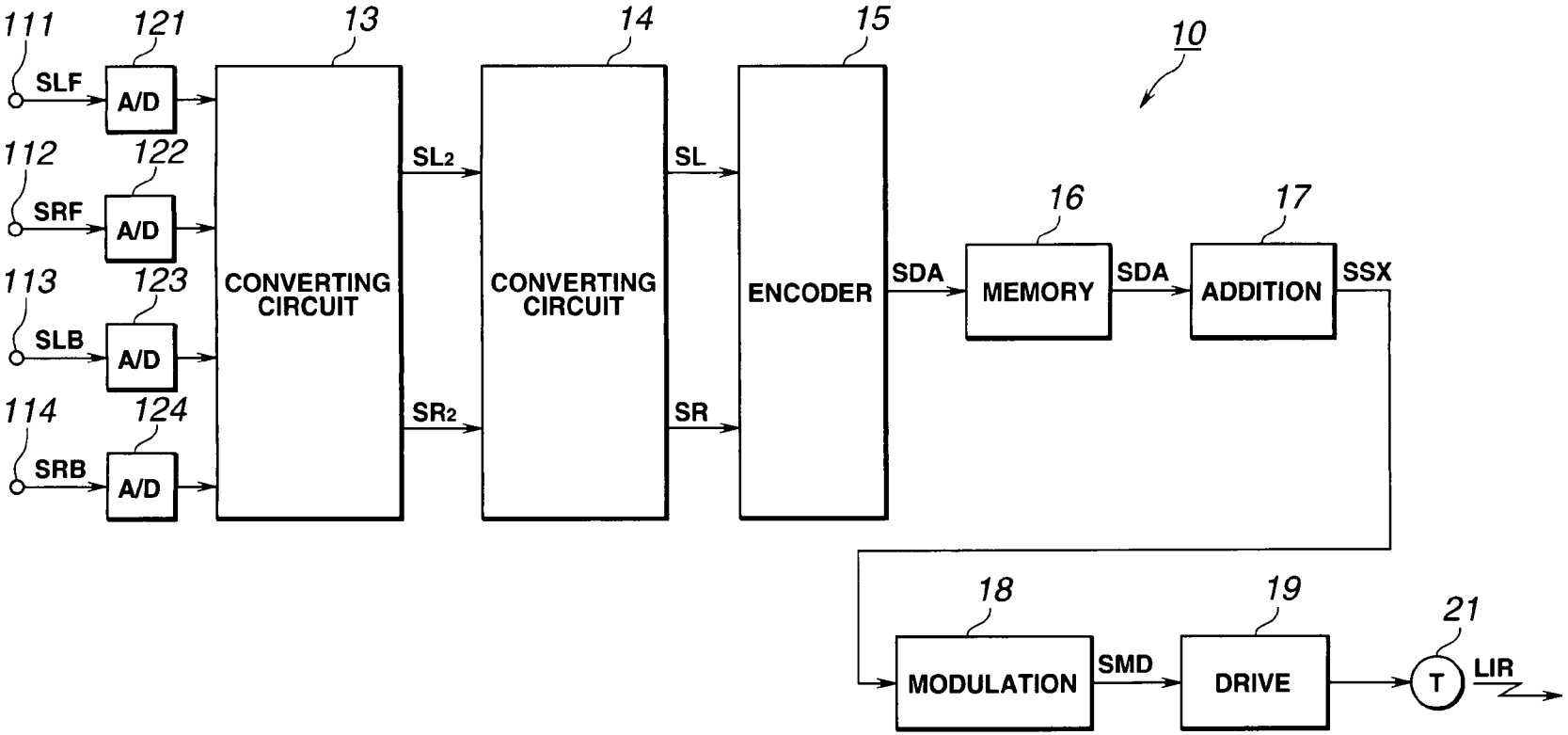
FIG. 1 is a block circuit diagram showing a transmitting apparatus according to this invention.
Figure 2:
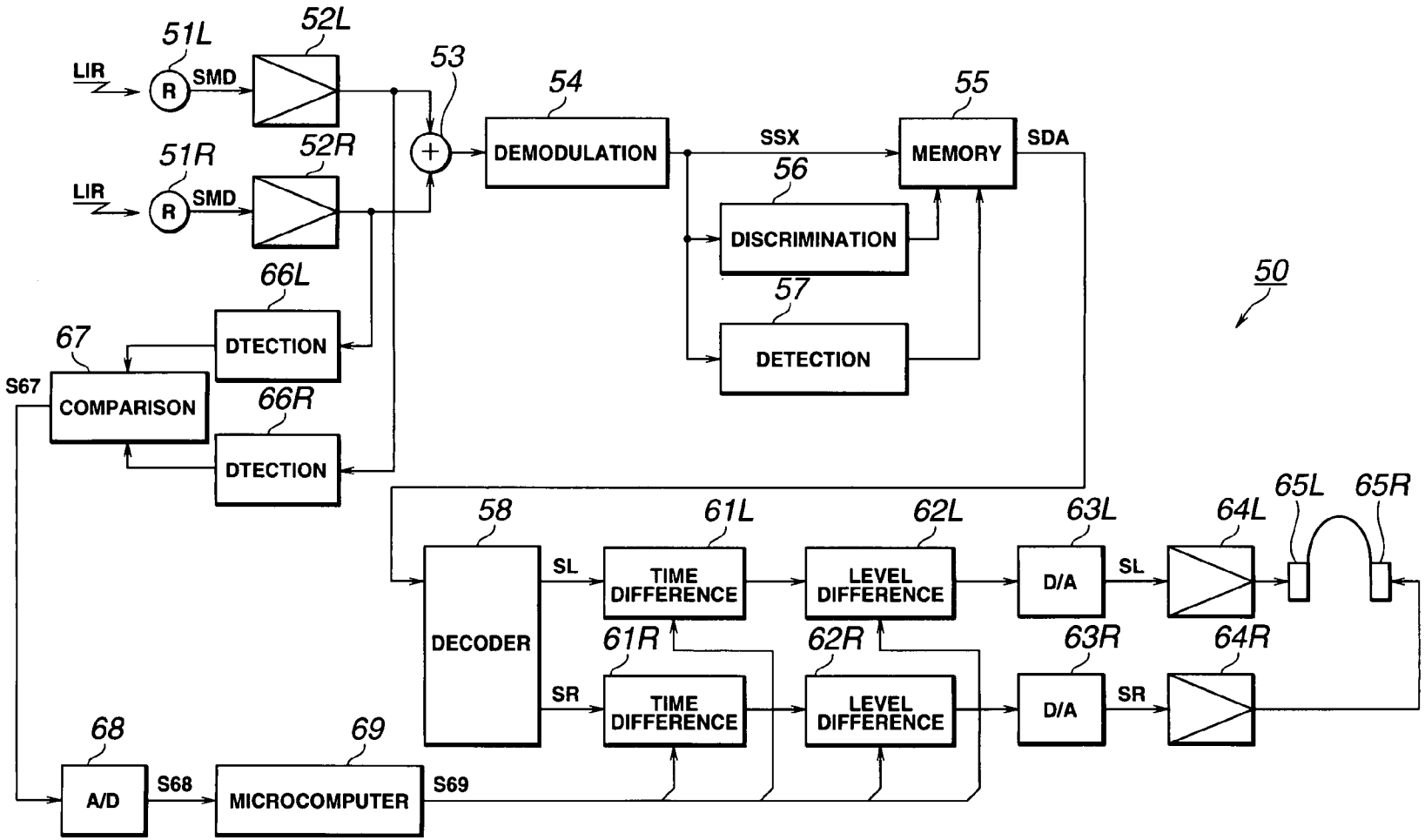
FIG. 2 is a block circuit diagram showing a reproducing apparatus using headphone device according to this invention.

Transmitting apparatus 10 according to this invention is constituted as shown in FIG. 1, and a headphone device constituting the reproducing apparatus adapted to receive audio signal transmitted from this transmitting apparatus 10 to reproduce it has a configuration as shown in FIG. 2.

In the following description, reference symbols SLF, SRF SLB, SRB are audio signals of 4-channels, and when these signals SLF, SRF, SLB, SRB are respectively delivered to speaker units serving as electroacoustic conversion units disposed in left forward direction, right forward direction, left backward direction and right backward direction of listener, reproduction sound field of 4-channel stereo is realized.

In the transmitting apparatus 10 according to this invention, analog audio signals SLF~SRB are delivered to A/D converter circuits 121 to 124 through input terminals 111 to 114, and are caused to undergo A/D conversion at these A/D converter circuits 121 to 124. The audio signals SLF~SRB which have been caused to undergo A/D conversion are delivered to a channel converting circuit 13 constituted by, e.g., DSP (Digital Signal Processor). Although the detail of the channel converting circuit 13 will be described later, the channel converting circuit 13 converts audio signals SLF~SRB into audio signals SL2, SR2 in which reproduction sound field of 4-channel stereo can be obtained by two speaker units. Namely, the channel converting circuit 13 serves to convert signals SLF~SRB into signals SL2, SR2 so as to realize reproduction sound field equivalent to reproduction sound field obtained when audio signals SLF, SRF, SLB, SRB of 4 channels are delivered to speaker units disposed in left forward direction, right forward direction, left backward direction and right backward direction of listener. While audio signals SLF~SRB, SL2, SR2 are digital signals at this time point, explanation has been given on the assumption that they are analog signals for avoidance of complexity of the description. This will similarly apply to the following description.

Figures 3A, 3B, 3C, 3D, 3E, 3F:
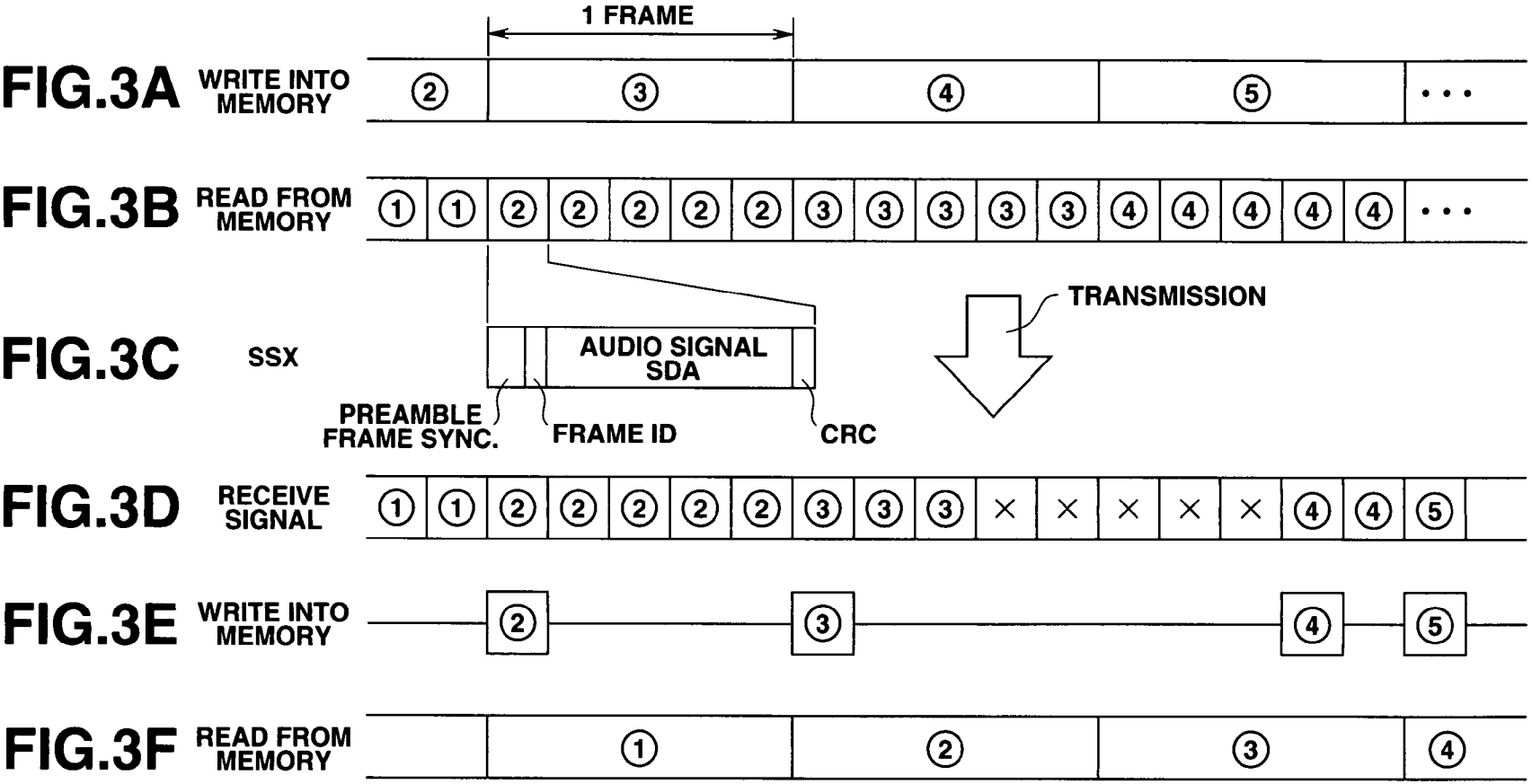
FIG. 3 is a view for explaining the state where digital audio signal is written into memory of the transmitting apparatus and signal written into the memory is read out.

Further, audio signals SL2, SR2 are delivered to a sound field converting circuit 14. While the detail of the sound field converting circuit 14 will be described later, it is constituted by, e.g., DSP (Digital Signal Processor) and serves to convert audio signals SL2, SR2 into audio signals SL, SR where sound image localization is obtained outside the head when listener listens to them by the headphone device. Namely, the sound field converting circuit 14 serves to convert audio signals SL2, SR2 into audio signals SL, SR where sound image localization is obtained outside the head so as to realize reproduction sound field equivalent to reproduction sound field obtained when audio signals SL2, SR2 are delivered to speaker units disposed in the left forward direction and the right forward direction of listener in order that audio signals SL, SR are delivered to the headphone device. These audio signals SL, SR are delivered to an encoder circuit 15, at which they are converted into digital audio signal SDA of 1 channel alternately having audio signals SL, SR by one sample. This signal SDA is delivered to a memory circuit 16 for signal repetition and time axis compression. Namely, as shown in FIG. 3A, when the signal portion obtained by partitioning signal SDA every, e.g., 5 seconds is assumed to be 1 frame, the memory circuit 16 is caused to be of configuration including ring memory having capacity of 2 frames. In addition, the memory circuit 16 is continuously supplied with write signals (and write address signals. This similarly applies to the following description). As shown in FIG. 3A, signals SDA are continuously written into the memory circuit 16.

Moreover, the memory circuit 16 is also supplied with read-out signal, wherein this read-out signal has speed about five times greater than that of write signal. In this case, read address signal is also included in the read signal. Further, the read address is address delayed by one frame with respect to the write address, and is repeated by five times every one frame time period. Accordingly, from the memory circuit 16, as shown in FIG. 3B, signals SDA in which time axis compression is implemented so that time length is equal to about one fifth are read out, and signals SDA are repeatedly read out by five times every respective frame time periods. The signal SDA thus read out is delivered to a data addition circuit 17, at which it is caused to be signal SSX as shown in FIG. 3C, for example. This signal SSX has, every one frame of the time axis compressed signal SDA, frame synchronizing signal doubling as preamble signal and frame identification (ID) signal before that signal SDA, and has CRC code after the signal SDA. In this case, the frame ID signal indicates to which signal of frame before time axis compression the added time axis compressed signal SDA corresponds, e.g., whether or not it is signal of odd frame or signal of even frame.

The signal SSX is delivered to a modulation circuit 18 as modulation signal, at which it is converted into, e,g., MSK signal SMD. This signal SMD is delivered to an infrared light emitting element 21 using infrared LED through a drive amplifier 19. From the infrared light emitting element 21, infrared rays LIR of which light quantity is modulated by the signal SMD are outputted.

On the other hand, in headphone device 50, as shown in FIG. 2, infrared rays LIR outputted from the transmitting apparatus 10 are received by light receiving elements 51L, 51R using, e.g., photo-diode. Thus, MSK signals SMD, SMD are taken out. These signals SMD, SMD are delivered to an adding circuit 53 through amplifiers 52L, 52R, resulting in one signal SMD. This signal SMD is delivered to a demodulation circuit 54. Thus, original signal SSX is demodulated.

FIG. 3D shows an example of the demodulated signal SSX. In FIG. 3D, frames to which mark x is attached indicates invalid frame in which infrared rays LIR cannot be normally received by fault, etc. resulting in missing portion or error in the signal SDA, and frames to which no mark x is attached are valid frames. Further, this demodulated signal SSX is delivered to a memory circuit 55, at which time axis expansion processing and defect correction processing are carried out. For this reason, the memory circuit 55 is caused to be of configuration so as to have ring memory having capacity corresponding to 2 frames of signal SDA before time axis compression. Further, the memory circuit 55 is supplied with write signal changing at speed equal to read signal with respect to the memory circuit 16. In this case, signal SSX from the demodulation circuit 54 is delivered to a frame discrimination circuit 56. By frame ID signal included in the signal SSX, whether frame of received signal SSX is odd frame or even frame is discriminated every one frame after time axis compression. Thus, its discrimination result is delivered to the memory 55. In addition, signal SSX from the demodulation circuit 54 is delivered to an error detection circuit 57. By CRC code included in the signal SSX, whether or not error takes place in the received signal SDA is detected every one frame after time axis compression. Thus, its detection result is delivered to the memory circuit 55.

In this way, as shown in FIG. 3E, for example, first valid signal SDA at respective frame time periods before time axis compression of the signals SSX is written into the memory circuit 55 by one frame. At this time, the memory circuit 55 is also supplied with read signal. This read signal is caused to have speed equal to that of write signal into the memory circuit 16. In addition, the read address is caused to be address delayed by one frame with respect to write address. Accordingly, signal SDA which has been time axis-expanded so as to have original time axis length is continuously read out as a whole as shown in FIG. 3F from the memory circuit 55.

The signal SDA thus read out is delivered to a decoder circuit 58, at which it is separated into original digital audio signals SL, SR. These signals SL, SR are delivered to D/A converter circuits 63L, 63R through addition circuits 61L, 61R for time difference and addition circuits 62L, 62R for level difference which will be described later, at which they are D/A converted into analog audio signals SL, SR. These audio signals SL, SR are delivered to speaker units 65L, 65R constituting left and right electroacoustic conversion units through amplifiers 64L, 64R.

Figure 4:
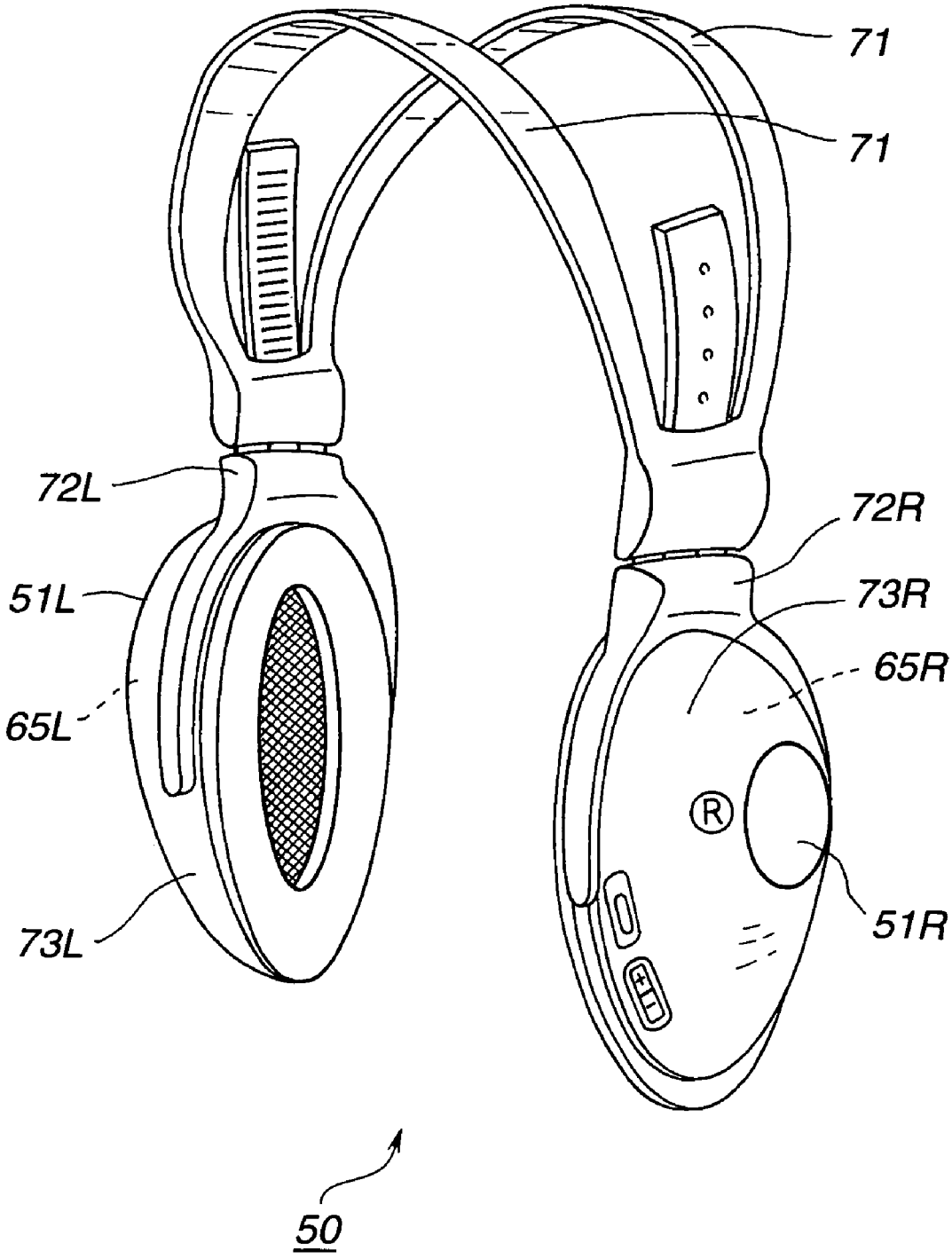
FIG. 4 is a perspective view showing headphone device constituting the reproducing apparatus according to this invention.

The headphone device 50 to which this invention is applied is caused to be of head mount type fitted so as to cover the head portion as shown in FIG. 4. Housings 73L, 73R are supported through supporting members 72L, 72R at both ends of a head band 71, and speaker units 65L, 65R are accommodated within the housings 73L, 73R. Within the housings 73L, 73R which accommodate speaker units 65L, 65R, circuits including light receiving elements 51L, 51R to amplifiers 64L, 64R, circuits 66L to 69 which will be described later, and battery for power supply (not shown) are accommodated. Light receiving portions of the light receiving elements 51L, 51R are fased to the external of the housings 73L, 73R.

The headphone device 50 constituted in this way can receive audio signals SLF~SRB transmitted by infrared rays LIR, and external connection cord for supply of audio signal becomes unnecessary, resulting in the fact that wireless structure is realized.

The transmitting apparatus 10 which transmits, by using infrared rays LIR, audio signals SLF~SRB received by the headphone device 50 according to this invention repeatedly transmits the same frame as shown in FIG. 3C, and the headphone device 50 uses a valid frame thereof. Accordingly, even if infrared rays LIR that the headphone device 50 receives are interrupted as indicated by mark x in FIG. 3D, for example, as the result of the fact that listener who has affixed the headphone device walks about, signal SDA can be normally obtained. Listener can normally hear reproduction sound.

Further, the transmitting apparatus 10 converts, by the channel converting circuit 13, audio signals SLF~SRB of 4 channels into audio signals SL2, SR2 in which there is obtained reproduction sound field equivalent to the case where those audio signals SLF~SRB are delivered to four speaker units and are reproduced thereat even when they are delivered to two speaker units to further convert, by the sound field converting circuit 14, these signals SL2, SR2 into audio signals SL, SR in which there is obtained reproduction sound field equivalent to the case where they are delivered to two speaker units to reproduce them even when headphone device is employed. Accordingly, when audio signals SL, SR are delivered to speaker units 65L, 65R, reproduction sound field equivalent to the case where they are delivered to four speaker units and are reproduced can be reproduced.

Explanation will now be given in connection with the processing that the channel converting circuit 13 converts the number of channels. In this case, the example where the channel converting circuit 13 is constituted by discrete circuits is indicated.

Figure 5:
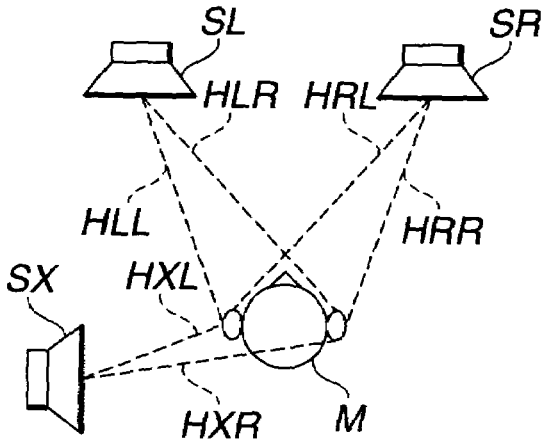
FIG. 5 is a plan view showing arrangement state of sound sources in which sound sources are disposed at left forward portion and right forward portion of listener to reproduce sound source at arbitrary position outside the head.

Here, as shown in FIG. 5, there is shown the state where sound sources SL, SR are disposed in the left forward direction and the right forward direction of listener M and sound source SX is equivalently reproduced at an arbitrary position outside the head by these sound sources SL, SR.

When it is assumed that

HLL is transfer function extending from sound source SL to left ear of listener M, HLR is transfer function extending from the sound source SL to right ear of the listener M, HRL is transfer function extending from sound source SR to the left ear of the listener M, HRR is transfer function extending from the sound source SR to the right ear of the listener M, HXL is transfer function extending from sound source SX to the left ear of the listener M, and HXR is transfer function extending from the sound source SX to the right ear of the listener, the sound sources SL, SR can be expressed as follows.

$$SL=(HXL\times HRR-HXR\times HRL)/(HLL\times HRR-HLR\times HRL)\times SX \quad (1)$$

$$SR=(HXR\times HLL-HXL\times HLR)/(HLL\times HRR-HLR\times HRL)\times SX \quad (2)$$

When input audio signal SX corresponding to the sound source SX is delivered to speaker unit disposed at position of sound source SL through filter which realizes the transfer function portion of the first formula (1) and the signal SX is delivered to speaker unit disposed at position of sound source SR through filter which realizes the transfer function portion of the second formula (2), sound image by the audio signal SX can be localized at position of the sound source SX.

Figure 6:
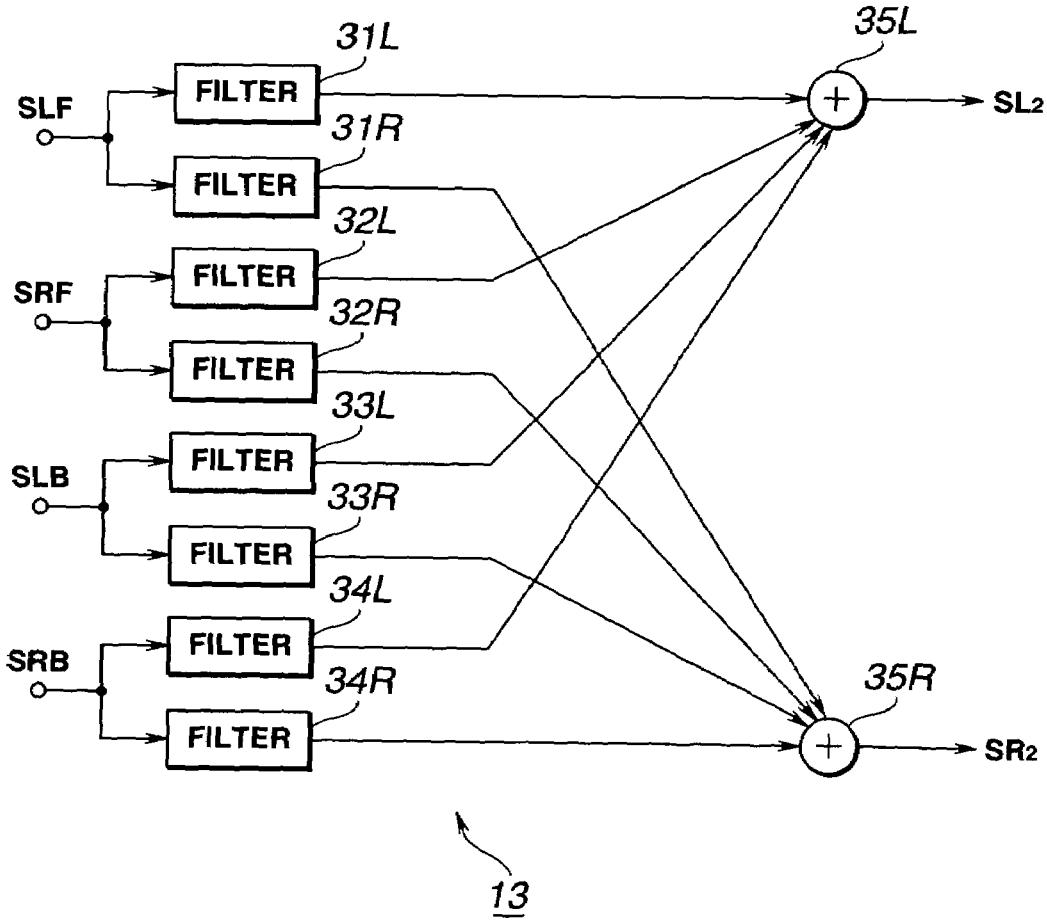
FIG. 6 is a circuit diagram showing the channel converting circuit constituting the transmitting apparatus according to this invention.

In view of the above, the channel converting circuit 13 can be constituted, as shown in FIG. 6, for example, by FIR type digital filters 31L~34L, 31R~34R and adding circuits 35L, 35R. Namely, audio signals SLF~SRB from A/D converter circuits 121 to 124 are delivered to the adding circuit 35L through digital filters 31L~34L, and is delivered to the adding circuit 35R through digital filters 31R~34R. At this time, the transfer functions of the digital filters 31L~34L, 31R~34R are set to predetermined values as indicated by the above-described first and second formulas (1) and (2). Impulse response in which transfer function similar to the transfer function portions of the first formula and the second formula is converted into time axis is convoluted with respect to audio signals SLF~SRB. Accordingly, from the adding circuits 35L, 35R, there are taken out audio signals SL2, SR2 in which reproduction sound field when audio signals SLF~SRB of 4 channels are reproduced by 4 speaker units can be reproduced by 2 speaker units.

Explanation will now be given in connection with the case where the sound field converting circuit 14 is constituted by discrete circuits.

Figure 7:
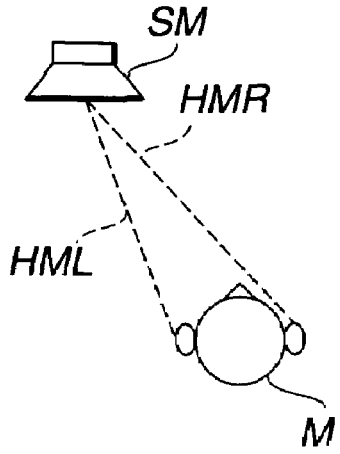
FIG. 7 is a view showing the state where there is formed a reproduction sound field when sound source is disposed in the forward direction of listener.

Here, in the case where sound source SM is disposed in the forward direction of listener M as shown in FIG. 7, when it is assumed that HML is transfer function extending from sound source SM to left ear of listener M and HMR is transfer function extending from sound source SM to right ear of the listener M, it is sufficient that the sound field converting circuit 14 realizes these transfer functions HML, HMR.

Figure 8:
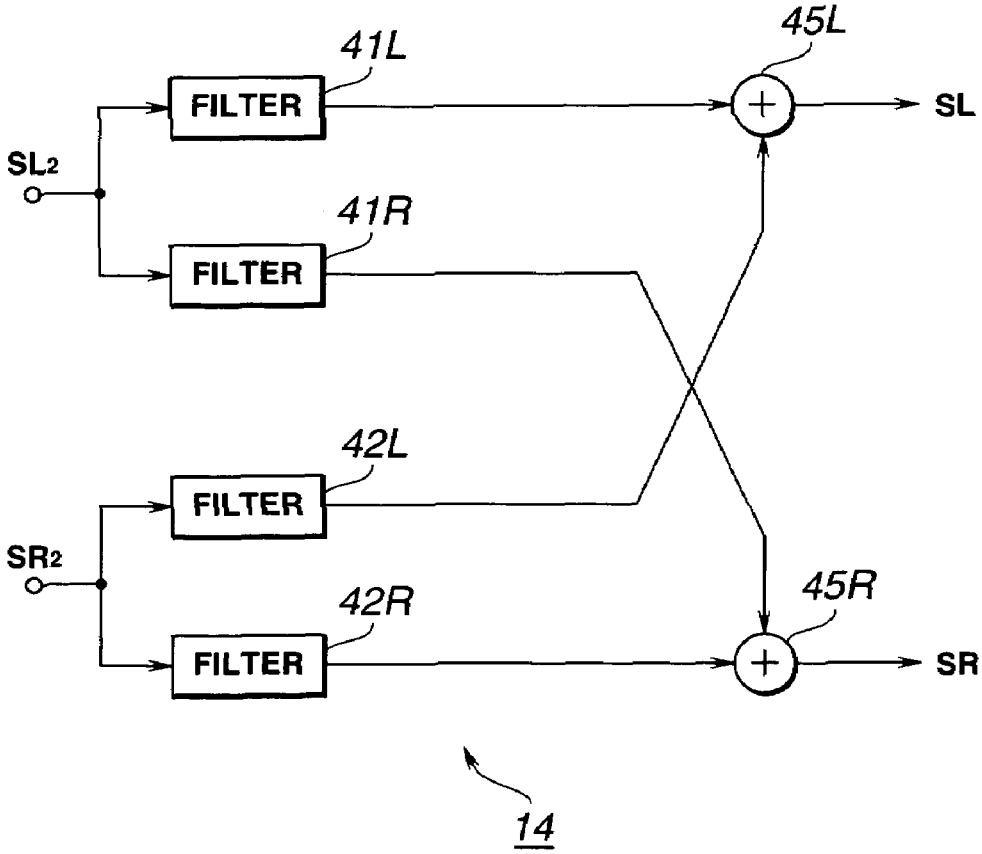
FIG. 8 is a circuit diagram showing the sound field converting circuit constituting the transmitting apparatus according to this invention.

In view of the above, as shown in FIG. 8, for example, the sound field converting circuit 14 can be constituted by FIR type digital filters 41L, 42L, 41R, 42R and adding circuits 45L, 45R. Namely, audio signals SL2, SR2 from the channel converting circuit 13 are delivered to the adding circuit 45L through digital filters 41L, 42L, and are delivered to the adding circuit 45R through digital filters 41R, 42R. At this time, transfer functions of the digital filters 41L~42R are set to predetermined values, and impulse response in which transfer functions HML, HMR are converted into time axis is convoluted with respect to the audio signals SL2, SR2. Accordingly, audio signal SL is outputted from the adding circuit 45L and audio signal SR is outputted from the adding circuit 45R. Namely, from the adding circuits 45L, 45R, there are taken out audio signals SL, SR in which reproduction sound field when audio signals SL2, SR2 are reproduced by two speaker units can be reproduced by the headphone device.

In this way, by the channel converting circuit 13, audio signals SLF~SRB of four channels are converted into audio signals SL2, SR2 in which there is obtained reproduction sound field equivalent to the case where they are reproduced by using four speaker units even when they are reproduced by using two speaker units. Further, by the sound field converting circuit 14, these signals SL2, SR2 are converted into audio signals SL, SR in which there is obtained reproduction sound field equivalent to the case where they are reproduced by two speaker units even when headphone device is employed. Accordingly, when audio signals SL, SR are delivered to speaker units 65L, 65R, there is reproduced reproduction sound field equivalent to the case where they are reproduced by using four speaker units.

It is to be noted that in the case where such an approach is only employed, localization position of sound image reproduced by speaker units 65L, 65R is fixed with respect to listener who has affixed the headphone device 50. Thus, when the listener moves his head, sound image also moves together. In view of this, the headphone device 50 is provided with additional circuits 61L~62R as described above. Even if listener changes direction of the head, such an approach is employed that position of sound image with respect to the outside is not changed. Namely, the additional circuits 61L, 61R are constituted by, e.g., variable delay circuit and the additional circuits 62L, 62R are constituted by, e.g., variable gain circuit.

Moreover, signals SMD, SMD outputted from amplifiers 52L, 52R are delivered to level detection circuits 66L, 66R, at which levels of the signals SMD, SMD are detected. Their detection results are delivered to a comparison circuit 67. Thus, signal S67 indicating level difference between signals SMD, SMD is taken out. In this case, when direction in which listener who has affixed headphone device 50 is directed deviates from the direction of infrared light emitting element 21 of the transmitting apparatus 10, polarity and magnitude of the signal S67 are changed in correspondence with direction and magnitude of that deviation. Accordingly, the signal S67 results in detection signal indicating direction in which listener is directed.

Figure 9:
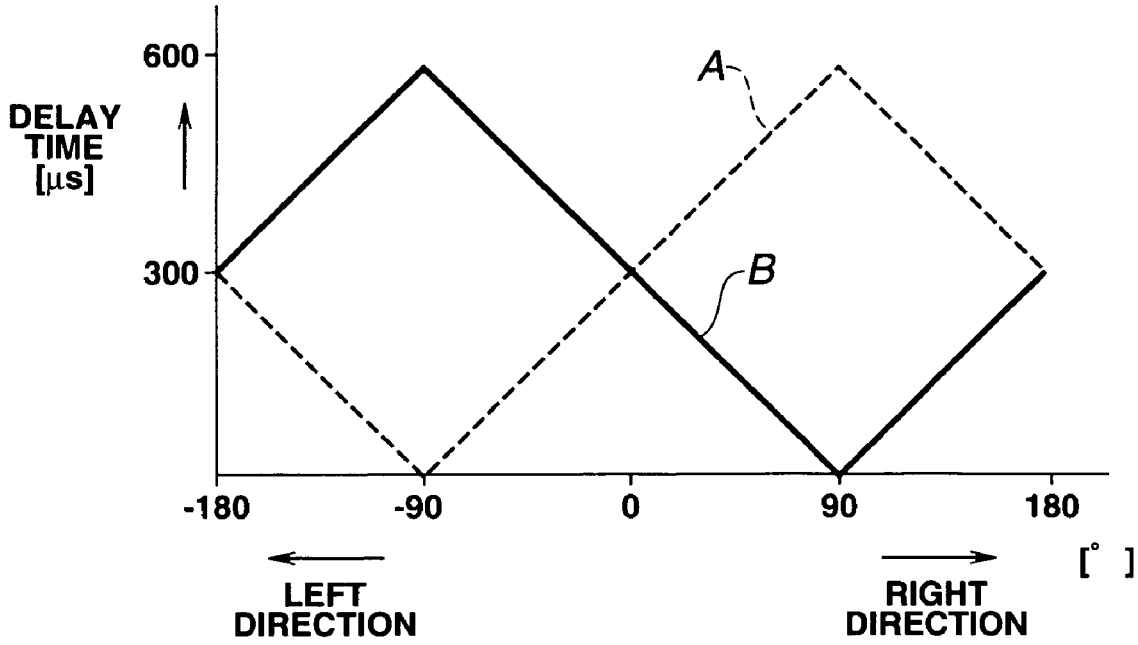
FIG. 9 is a characteristic diagram showing the characteristic of addition circuit for providing time difference with respect to audio signals for left and right channels.
Figure 10:
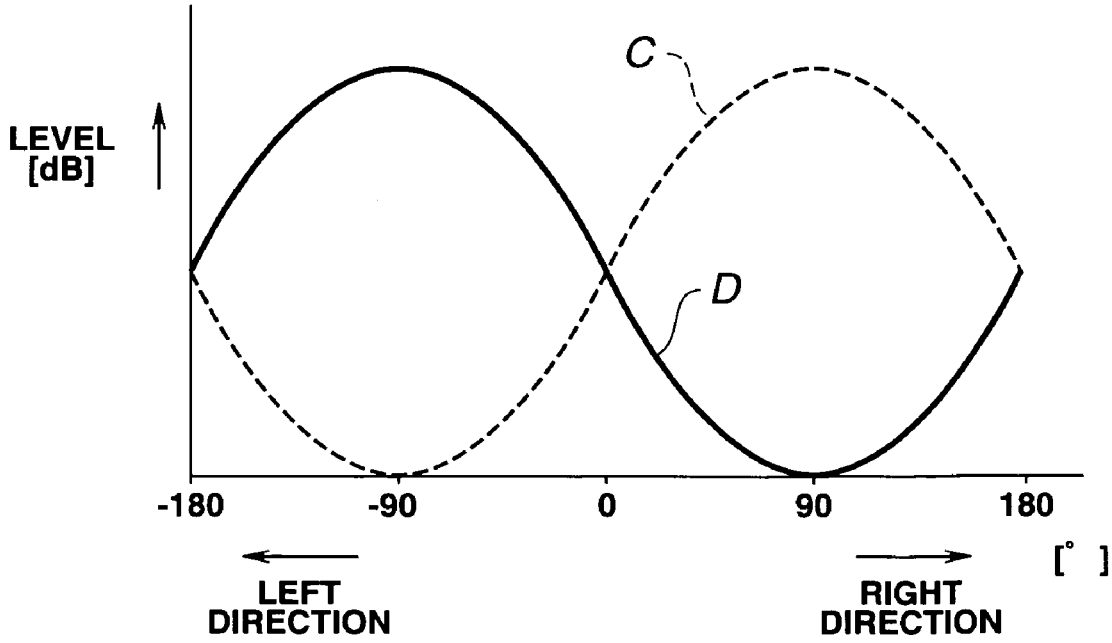
FIG. 10 is a characteristic diagram showing the characteristic of addition circuit for providing level difference with respect to audio signals for left and right channels.

The signal S67 indicating level difference between signals SMD, SMD is delivered to an A/D converter circuit 68, at which it is caused undergo A/D conversion into digital detection signal S68. The detection signal S68 which has been caused to undergo A/D conversion is delivered to a microcomputer 69. The microcomputer 69 converts the detection signal S68 into signal S69 of control data for actually localizing sound image and delivers this signal S69 to addition circuits 61L, 61R for time difference and addition circuits 62L, 62R for level difference as respective control signals for time difference and level difference. In this case, if listener turns to the right, e.g., when sound source is positioned in the forward direction of listener who has affixed the headphone device 50, time lag of sound wave incident to the left ear becomes small and the level becomes large. Accordingly, the characteristic of the additional circuit 61L is controlled as indicated by polygonal line B in FIG. 9, and the characteristic of the additional circuit 62L is controlled as indicated by curve C in FIG. 10. Moreover, since the left ear and the right ear are opposite in point of position, the characteristic of the additional circuit 61R is controlled as indicated by polygonal line A in FIG. 9 and the characteristic of the addition circuit 62R is controlled as indicated by curve D in FIG. 10. Accordingly, when listener changes direction of the head, time difference and level difference of signals SL, SR change in correspondence with that direction. As a result, sound image formed by speaker units 65L, 65R is localized at fixed position of the outside irrespective of direction of head.

For example, even when listener changes direction of the head in the case where he listens to music of orchestra, that orchestra is not moved, resulting in natural state such that direction of the head is changed in front of the orchestra. Further, in the case where reproduction of audio signal is being carried out along with video signal by digital video disc player for carrying out reproduction of audio signal along with video signal, even when direction of the head is changed, localization position of sound image can be in correspondence with position of image.

As described above, since the transmitting unit 10 and the headphone device 50 according to this invention are used to thereby have ability to transmit audio signals SLF~SRB to the headphone device 50 by infrared rays LIR to receive these signals by the headphone device 50, the headphone device 50 is permitted to be of wireless structure. In that case, even when infrared rays LIR that the headphone device 50 receives are interrupted as indicated by mark x in FIG. 3D, for example, as the result of the fact that listener who has affixed the headphone device walks about, or the like, it is possible to normally obtain signal SDA. Thus, listener can normally listen to reproduction sound.

Further, since the transmitting unit 10 according to this invention is adapted to carry out conversion of the number of channels by the channel conversion circuit 13 and to carry out conversion of sound field by the sound filed converting circuit 14, it is possible to reproduce reproduction sound field similarly equivalent to the case where audio signals transmitted from the transmitting unit are reproduced by using four speaker units when they are received and reproduced by the headphone device 50 according to this invention.

Further, the headphone device 50 according to this invention can localize sound image at a fixed position of the outside irrespective of direction of the head even when listener changes direction of the head.

In addition, even if coefficients of digital filters 41L~42R of the sound field converting circuit 14 are changed in accordance with movement of the head, position of sound image with respect to the outside can be fixed. In that case, however, if the head of listener is moved a little, it is required to update coefficients of digital filters 41L~42R every time. As a result, a large number of high speed product sum operation circuits and memory circuits are required. On the contrary, in the headphone device 50 according to this invention, since changes of transfer functions HML, HMR with respect to movement of the head are replaced or simulated by changes of time difference and level difference with respect to audio signals SL, SR, it becomes possible to greatly simplify the circuit scale.

Another example of the transmitting unit 10 according to this invention will now be described. This transmitting unit 10 is adapted to be connected to audio signal source of multi-channel structure and analog audio signal source of 2 channels.

Figure 11:
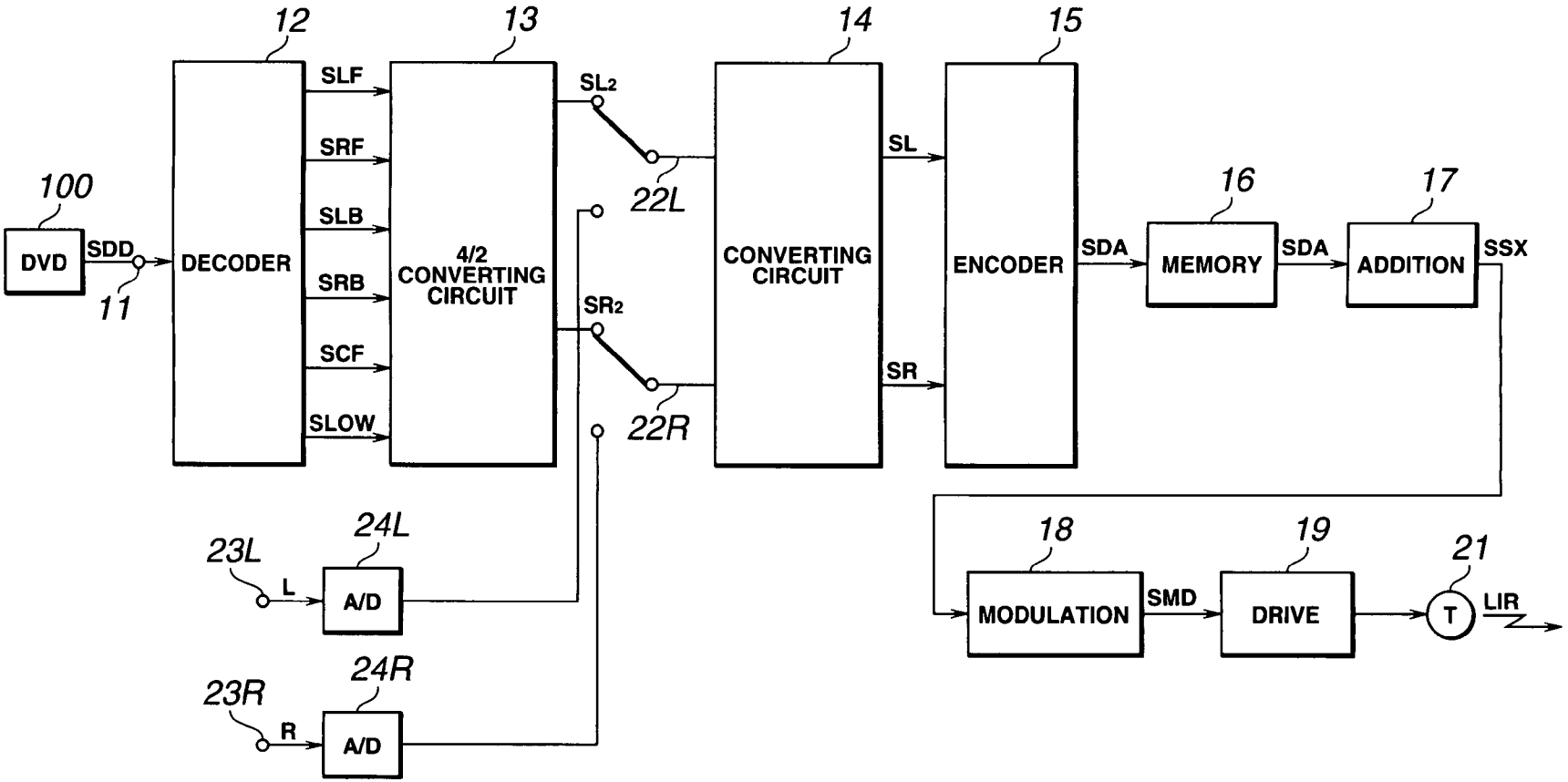
FIG. 11 is a block circuit diagram showing another example of the transmitting apparatus according to this invention.

Namely, in FIG. 11, reference numeral 100 denotes a signal source of digital audio signals of multi-channel structure. In this example, the signal source 100 is digital video disc player for reproducing audio signal along with video signal. In this digital video disc player 100, digital audio signal SDD of the so-called 5.1 channel in, e.g., Dolby digital system (AC-3) is outputted. This digital audio signal SDD is signal obtained as the result of the fact that digital audio signals of 6 channels SLF, SCF, SRF, SLB, SRB, SLOW in left forward direction, central forward direction, right forward direction, left backward direction, right backward direction and in low frequency band of 120 Hz or less are encoded into one serial data (bit stream). In general, this signal SDD is delivered to a dedicated adapter, at which it is decoded and is caused to undergo D/A conversion into original audio signals SLF~SLOW of 6 channels. These signals SLF~SLOW are delivered to respective speaker units. Thus, reproduction sound field is formed.

Figure 12:
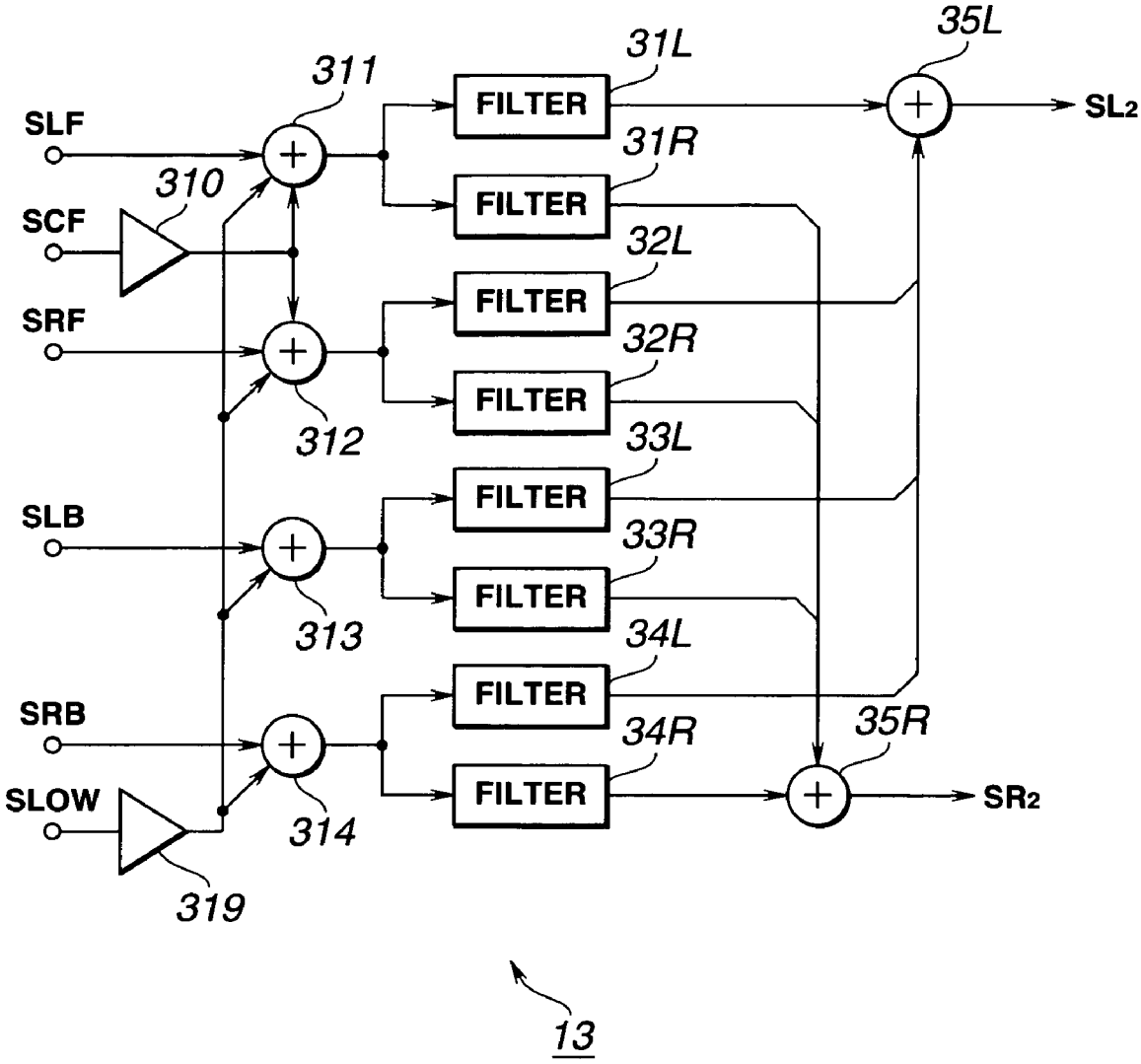
FIG. 12 is a circuit diagram showing the channel converting circuit for channel-converting audio signals used in the transmitting apparatus shown in FIG. 11.

Moreover, at the time of reproduction of the digital video disc player 100, digital audio signal SDD is delivered to an input terminal 11 of the transmitting unit 10 through coaxial cable from the player 100, and is further delivered to a decoder circuit 12, at which it is decoded into respective audio signals SLF~SLOW. These audio signals SLF~SLOW are delivered to the channel converting circuit 13. In the case where this channel converting circuit 13 is constituted by discrete circuits, it is constituted as shown in FIG. 12, for example. Namely, sound image reproduced by delivering audio signal SCF of the central forward channel to the speaker unit of the central forward portion can be reproduced by speaker units in left forward direction and right forward direction. In addition, since audio signal SLOW of lower frequency band channel has lower frequency, sound image formed by this signal SLOW has no directivity in general.

Thus, the channel converting circuit 13 shown in FIG. 12 delivers digital audio signals SLF, SRF from the decoder circuit 12 to digital filters 31L~32R through adding circuits 311, 312. Moreover, digital audio signal SCF from the decoder circuit 12 is caused to undergo processing such that its level is caused to be, e.g., ½ level by an attenuation circuit 310. The level converted signal thus obtained is delivered to the adding circuits 311, 312, at which it is distributed to audio signals SLF, SRF.

Further, digital audio signals SLB, SRB from the decoder circuit 12 are delivered to digital filters 33L~34L through adding circuits 313, 314. In addition, digital audio signal SLOW from the decoder circuit 12 is subjected to processing such that its level is caused to be, e.g., ¼ level by an attenuation circuit 319. The level converted signal thus obtained is then delivered to adding circuits 311 to 314, at which it is distributed to audio signals SLF~SRB.

In this example, circuits of succeeding stage from filters 31L~34R are caused to be of configuration similar to the channel converting circuit 13 of FIG. 6.

In this way, audio signals SLF~SLOW are converted into audio signals SL2, SR2 of 2 channels. Namely, these audio signals SL2, SR2 are formed by reproducing, by two speaker units, reproduction sound field equivalent to reproduction sound field obtained when such signals are delivered to speaker units respectively disposed at left forward portion, central forward portion, right forward portion, left backward portion and right backward portion of listener and speaker unit for lower frequency band in the channel conversion circuit 13.

Further, at the time of reproduction of the digital video disc player 100, audio signals SL2, SR2 from the channel converting circuit 13 are delivered to sound field converting circuit 14 through input selectors 22L, 22R, at which they are converted into audio signals SL, SR for headphone device. On the other hand, at the time of reproduction of analog audio signals L, R of 2 channel stereo, those audio signals L, R are delivered to A/D converter circuits 24L, 24R through input terminals 23L, 23R, at which they are caused to undergo A/D conversion into digital audio signals L, R. The audio signals L, R thus obtained are delivered to the sound field converting circuit 14 through input selectors 22L, 22R, at which they are converted into analog audio signals SL, SR for headphone device.

Signal processing similar to that of the transmitting unit 10 shown in FIG. 1 is executed with respect to audio signals SL, SR for headphone device outputted from the sound field converting circuit 14. Thus, infrared rays LIR are transmitted to the headphone device 50. When such infrared rays LIR are received by the headphone device 50 shown in FIG. 2, for example, reproduction sound of audio signal SDD reproduced by the digital video disc player 100, or reproduction sound of analog audio signals L, R delivered to input terminals 23L, 23R can be heard by the headphone device 50.

Also in this case, the headphone device 50 is permitted to be of wireless structure. Moreover, even if infrared rays LIR that the headphone device 50 receives are interrupted, listener can normally listen to reproduction sound. Further, even when headphone device is employed, it is possible to reproduce reproduction sound field equivalents to the case of 6-channel stereo or 2-channel stereo.

Figure 13:
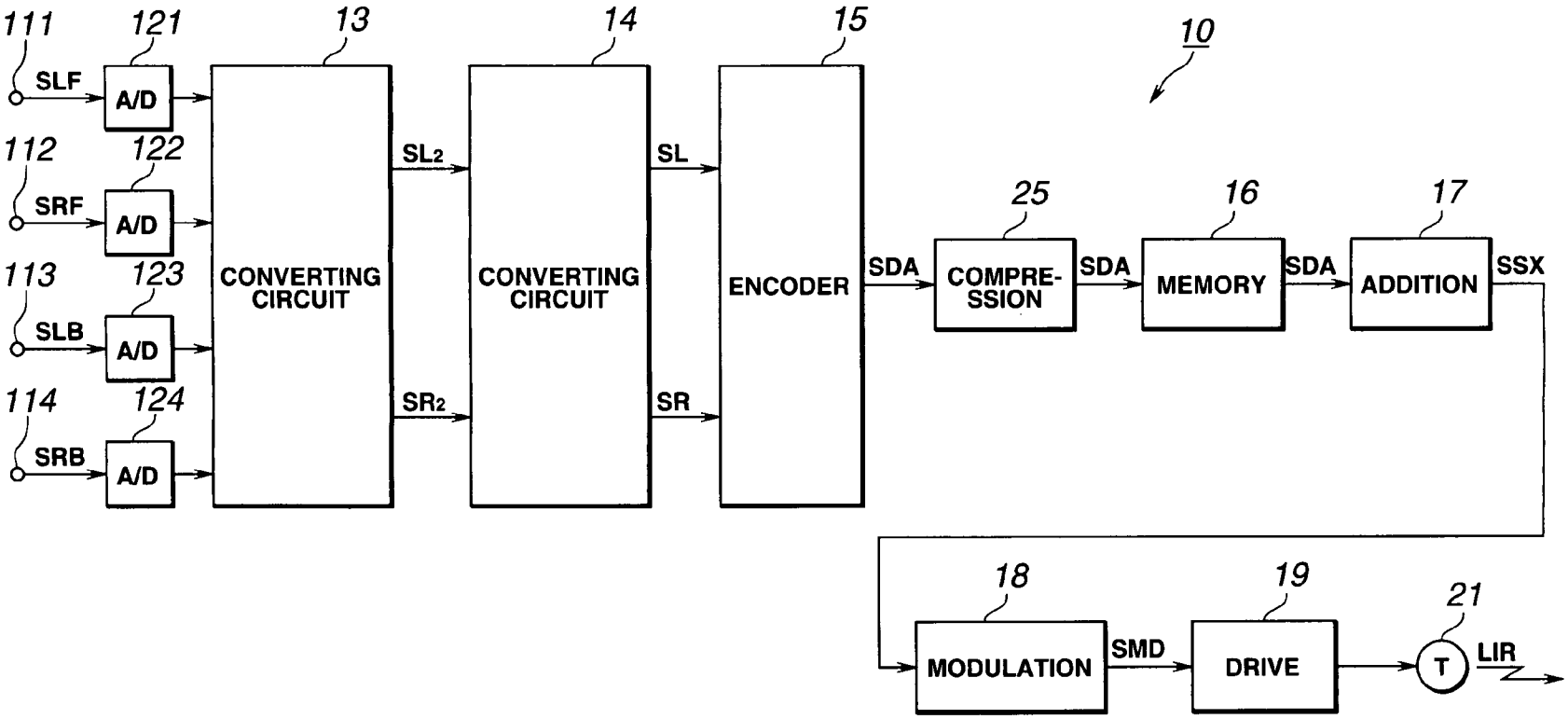
FIG. 13 is a block circuit diagram showing a further example of transmitting apparatus according to this invention adapted for allowing digital audio signal to undergo data compression to transmit it.
Figure 14:
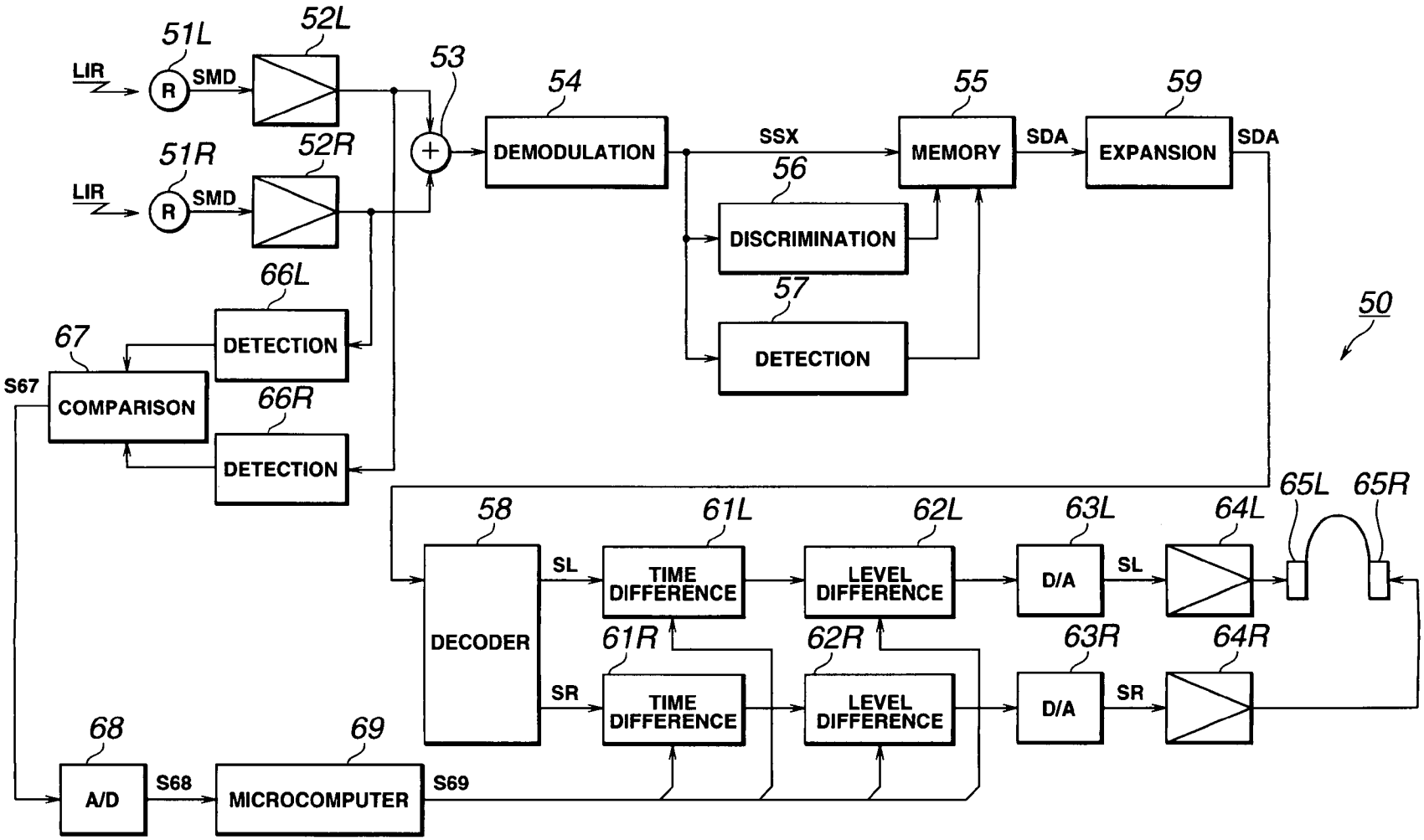
FIG. 14 is a block circuit diagram showing a further example of a headphone device according to this invention adapted to receive data-compressed transmitted digital audio signal to reproduce it.

The transmitting unit 10 and the headphone device 50 according to this invention may respectively carry out transmission/reception of digital audio signal SDA after undergone data compression as shown in FIGS. 13 and 14.

As shown in FIG. 13, this transmitting unit 10 delivers digital audio signal SDA from encoder circuit 15 to a data compression circuit 25 so that data quantity is data-compressed into data quantity of about 1/5, e.g., by the data compression processing system used in magneto-optical disc used in recording/reproduction of audio signal. The data compressed signals SDA are continuously written into memory circuit 16 as shown in FIG. 3A, for example, and are caused to undergo time axis compression into time length of about ⅕. Thus, such signals are repeatedly read out by five times every respective frame time periods.

In this case, the digital audio signal SDA which has been read out is caused to undergo time axis compression, but such signal is caused to undergo data compression so that data quantity becomes equal to about ⅕ as compared to digital audio signal SDA when outputted from the encoder circuit 15. Accordingly, the digital audio signal SDA which has been read out from the memory circuit 16 can have date rate equal to that of digital audio signal SDA which has been outputted from the encoder circuit 15 or value nearly equal thereto.

The digital audio signal SDA which has been read out from the memory circuit 16 is delivered to addition circuit 17, at which processing similar to the case of the transmitting unit 10 shown in FIG. 1 is executed at times subsequent thereto. The signal thus processed is transmitted by infrared rays LIR.

On the other hand, at the headphone device 50, infrared rays LIR transmitted from the transmitting unit 10 are received by, e.g., light receiving elements 51L, 51R. At times subsequent thereto, processing similar to the case of the headphone device 50 shown in FIG. 2 are executed. As shown in FIG. 3F, from the memory circuit 55, data-compressed digital audio signals SDA are continuously taken out. The digital audio signal SDA thus taken out is delivered to a data expanding circuit 59, at which it is data-expanded into digital audio signal SDA of original data length. This signal SDA is delivered to a decoder circuit 58. At times subsequent thereto, processing similar to the case of the headphone device 50 shown in FIG. 2 are executed. Thus, audio signals SL, SR are respectively delivered to speaker units 65L, 65R of the headphone device 50.

Also in the transmitting device 10 shown in FIG. 13 and the headphone device 50 shown in FIG. 14, even if infrared rays LIR received by the headphone device 50 are temporarily interrupted, it is possible to normally obtain reproduction sound. In addition, in that case, since data rate when digital audio signal SDA is transmitted by infrared rays LIR is suppressed, that transmitting operation is easy.

Figure 15:
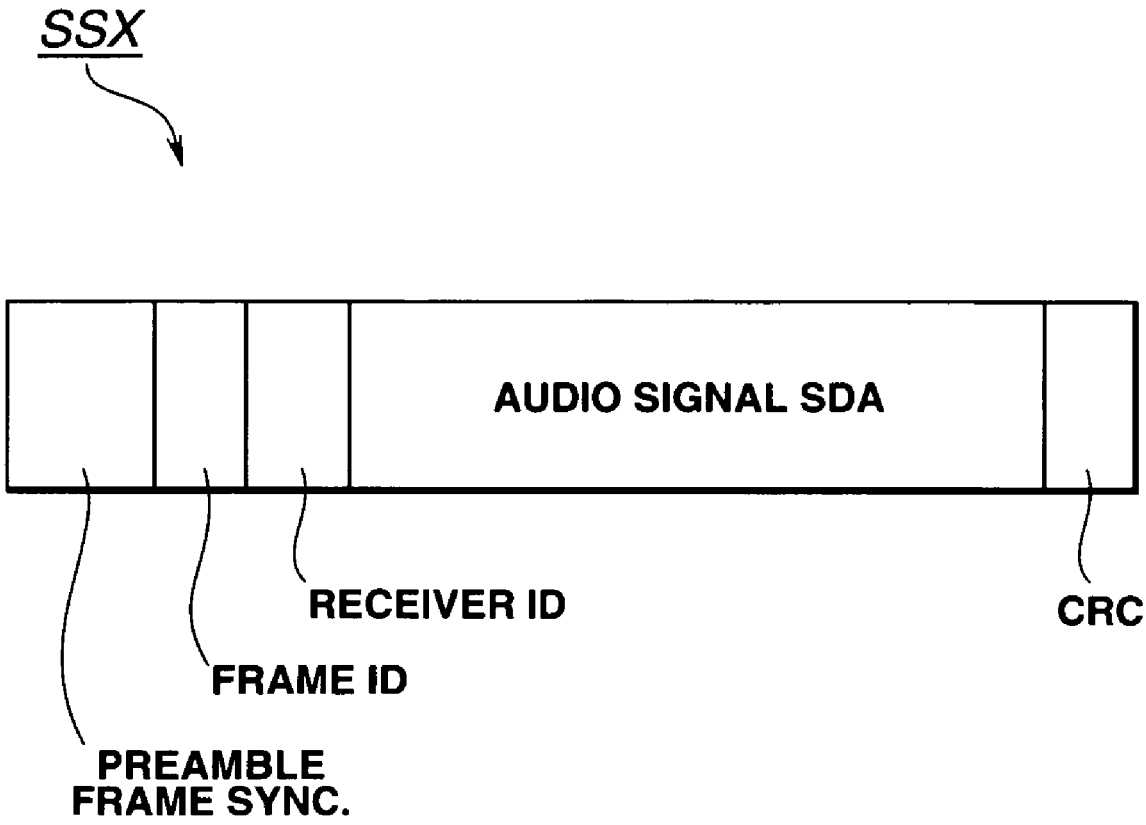
FIG. 15 is a view showing the configuration of a signal caused to include receiver identification (ID) code for specifying headphone device in signal transmitted from transmitting apparatus.

It is to be noted that while, in the above-described example, if infrared rays LIR are within the arrival range thereof, the audio signal transmitted from one transmitting unit 10 can be received by plural headphone devices 50, only specific headphone device 50 may receive audio signal. To realize this, as shown in FIG. 15, for example, such an approach may be employed to include receiver identification (ID) code for specifying headphone device 50 in signal SSX transmitted from the transmitting unit 10, and to provide, at the headphone device 50 side, a processing circuit adapted for comparing receiver ID code included in received signal SSX and receiver ID code given to the specific headphone device 50 to carry out receiving processing of digital audio signal SDA only when both codes are in correspondence with each other.

Moreover, while, in the above-described example, as shown in FIG. 3E, for example, only signal SDA first valid at each frame time period before time axis compression of signals SDA transmitted from the transmitting unit 10 received by the headphone device 50 is written into the memory 55, such an approach may be employed to write all of valid signals SDA, i.e., overwrite the same valid signals SDA.

Further, such a configuration may be employed that, in the transmitting unit 10, interleave processing and addition processing of error correction code are implemented to signal SDA to transmit such a signal, and in the headphone device 50, deinterleave processing and error correction processing are implemented to the received signal SDA. By employing such a configuration, it is possible to improve tolerance with respect to receiving fault of infrared rays LIR.

Further, there may be employed a configuration such that light receiving element (TOS link) is used at input terminal 11 provided at the transmitting unit 10 to allow digital audio signal SDD delivered to the transmitting unit 10 to be an optical signal. Further, piezoelectric vibration gyro-scope or geometric azimuth sensor, etc. may be provided at the headphone device 50 to detect direction of the head of listener.

In addition, such an approach may be employed that when localization position of sound image is fixed in accordance with detection signal S67 of movement of the head of listener, that signal S67 is transmitted from the headphone device 50 to the transmitting unit 10 by infrared rays, etc., and, in the transmitting unit 10, transfer functions of digital filters 41L~42R in the sound field converting circuit 14 are controlled in accordance with received detection signal S67. In this case, addition cricuits 61L~62R may be omitted.

INDUSTRIAL APPLICABILITY

Since the transmitting apparatus according to this invention can transmit, by infrared rays, audio signals to the headphone device according to this invention to receive them by the headphone device, the headphone device is permitted to be of wireless structure. In addition, even in the case where infrared rays transmitted from the transmitting apparatus are temporarily interrupted as the result of the fact that listener who has affixed headphone device walks about or the like, audio signals can be received by the reproducing unit provided with headphone device without interruption to securely listen to them as continuous reproduction sound.

What is claimed is:

1. A transmitting apparatus comprising:

a memory adapted to temporarily write digital audio signals inputted thereto to repeatedly implement time axis compression processing, every unit time period, to the digital audio signals thus written to write and read them for a second time;

a compression circuit for implementing compression to the digital audio signal which has been read out from the memory;

a modulation circuit for carrying out modulation of the compressed digital audio signal; and an infrared light emitting element for converting a modulated signal outputted from the modulation circuit into infrared rays.

2. The transmitting apparatus as set forth in claim 1, wherein data for demodulating the audio signal that a headphone device affixed onto listener designated in advance receives and identifies is added to the signal delivered to the modulation circuit.

3. The transmitting apparatus as set forth in claim 1 comprising:

a channel converting circuit for converting audio signals of multi-channel structure into audio signals of 2 channels in which a sound image is localized at a predetermined position of a listener; and a sound field converting circuit for implementing, on a basis of a head portion transfer function from two electroacoustic conversion units up to both ears of the listener, signal processing to audio signals of 2 channels to which channel conversion processing has been implemented by the channel converting circuit.

4. The transmitting apparatus as set forth in claim 3, wherein data for permitting demodulation of the audio signal that a headphone device of listener designated in advance identifies and receives is added to the signal delivered to the modulation circuit.

5. A reproducing apparatus provided with a headphone device comprising: a memory adapted to temporarily write digital audio signals inputted thereto to repeatedly implement time axis compression processing, every unit time period, to the digital audio signals written to write and read them for a second time;

a modulation circuit for carrying out modulation of the digital audio signal which has been read out from the memory; and an infrared light emitting element for converting a modulated signal outputted from the modulation circuit into infrared rays, the reproducing apparatus comprising:

a light receiving element for receiving the infrared ray;

a demodulation circuit for demodulating the modulated signal outputted from the light receiving element to output a compressed digital audio signal;

an expansion circuit for implementing expansion processing to the compressed digital audio signal for restoration to a digital audio signal which has not undergone compression processing;

a memory for allowing the digital audio signal outputted from the expansion circuit to be repetitive signals to which time axis compression has been implemented every unit time to write signals of unit time period, and to implement thereto time axis expansion processing and defect correction processing of unit time period to carry out write and read operations thereof;

a D/A converter circuit for allowing the digital audio signal which has been read out from the memory to undergo D/A conversion output an analog audio signal; and an electroacoustic conversion unit supplied with the analog audio signal outputted from the D/A converter.

6. The reproducing apparatus provided with the headphone device as set forth in claim 5, wherein data for designating headphone device is added to the digital audio signal outputted from the demodulation circuit, and processing of the signal can be made only where the data is in correspondence with a designated select condition.

7. The reproducing apparatus provided with the headphone device as set forth in claim 5, wherein digital audio signals outputted from the demodulation circuit are of a multi-channel structure and are converted into audio signals of 2-channels in which a sound image is localized at a predetermined position of a listener, signal processing is carried out on a basis of a head portion transfer function from two electroacoustic conversion units up to both ears of the listener, and the digital audio signal is the time-axis compressed digital audio signal, the reproducing apparatus further comprising:

a time difference additional circuit for providing a time difference with respect to audio signals delivered to the electroacoustic conversion units;

a level difference additional circuit for providing a level difference with respect to the audio signals delivered to the electroacoustic conversion units; and detecting means for detecting a direction of the head of the listener to control the time difference and the level difference in correspondence with the detected direction of the head of the listener by a detection signal of the detecting means.

8. The reproducing apparatus provided with the headphone device as set forth in claim 7, wherein data for designating the headphone device is added to the digital audio signal outputted from the demodulation circuit, and processing of the signal can be made only where the data is in correspondence with a designated select condition.

* * * * *